US006457997B1

(12) United States Patent
Fan

(10) Patent No.: US 6,457,997 B1
(45) Date of Patent: Oct. 1, 2002

(54) ELECTRICAL CONNECTOR WITH PARTITION

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/952,966

(22) Filed: Sep. 13, 2001

(30) Foreign Application Priority Data

Jul. 20, 2001 (TW) ..... 90212269 U

(51) Int. Cl.[7] ..... H01R 33/00
(52) U.S. Cl. ..... 439/660
(58) Field of Search ..... 439/660, 701

(56) References Cited

U.S. PATENT DOCUMENTS 5,176,541 A * 1/1993 Mori ..... 439/660
5,697,816 A * 12/1997 Wu ..... 439/660
6,312,295 B2 * 11/2001 Nishimatsu ..... 439/660

* cited by examiner

*Primary Examiner*—Gary F. Paumen
(74) *Attorney, Agent, or Firm*—Wei Te Chung

(57) ABSTRACT

An electrical connector (4) includes an insulative housing (1), a plurality of conductive terminals (2), and an insulative partition (3). The housing includes a body (15) defining a receiving cavity (14), an inner step (17) adjacent the cavity, and two arms (13) depending from the body. The terminals are arranged into two opposite rows. The terminals have contact portions (220) electrically engaging with a mating connector, and support portions (222) extending from ends of the contact portions. The partition is inserted between the two rows of terminals and located between the two arms. A blocking surface (302) of the partition sandwiches the support portions between the blocking surface and the inner step of the housing, to thereby securely fix the terminals in the housing.

1 Claim, 5 Drawing Sheets

ELECTRICAL CONNECTOR WITH PARTITION

BACKGROUND OF THE INVENTION

1. Field of the Invention

The present invention generally relates to electrical connectors and, particularly to electrical connectors in which terminals of the connector can be securely fixed in position.

2. Related Art

An electrical connector is used to electrically connect two electrical devices. The electrical connector is oftentimes a cable connector. In modem high-density electrical connectors, it is difficult to solder wires of the cable to terminals of the connector. This is because soldering ends of the terminals are positioned close to each other.

An improved cable connector is disclosed in U.S. Pat. No. 5,697,816. Ends of terminals of the cable connector are arranged into two rows located in two planes, so as to increase the distance between the soldering ends and enable easy soldering of the terminals to corresponding wires. However, the terminals cannot be securely fixed in position, and may be longitudinally dislocated or distorted when the connector is mated with a plug connector.

Taiwan Patent Application No. 86214488 discloses a connector with a baseboard. The baseboard is arranged between two separated rows of terminals and locates the terminals in position. However, soldering ends of the terminals are positioned so close to each other that soldering wires of the cable to terminals of the connector is quite difficult. Furthermore, installation of the terminals requires the aid of two connecting patches. Thus manufacturing of the connector is unduly complicated and expensive.

Hence, a new improved electrical connector is desired to overcome the above problems.

SUMMARY OF THE INVENTION

An object of the present invention is to provide an electrical connector which can securely fix terminals thereof in position.

Another object of the present invention is to provide an electrical connector which is conveniently soldered to a cable and easy to manufacture.

To achieve the above objects, an electrical connector in accordance with a preferred embodiment of the present invention includes an insulative housing, a plurality of conductive terminals and an insulative partition. The housing includes a body defining a receiving cavity therein, an inner step adjacent the cavity, and two arms depending from the body. The terminals are arranged into two opposite rows. Each row of terminals comprises alternately arranged short and long terminals. Lower ends of the short and the long terminals are located at different positions to be conveniently soldered to a cable. The terminals have contact portions electrically engaging with a mating connector, and support portions extending from ends of the contact portions. The partition is inserted between the two rows of terminals and located between the two arms. The partition has a blocking surface sandwiching the support portions between the blocking surface and the inner step of the housing, to thereby securely fix the terminals in the housing.

These and additional objects, features and advantages of the present invention will become apparent after reading the following detailed description of preferred embodiments of the invention taken in conjunction with the appended drawings.

BRIEF DESCRIPTION OF THE INVENTION

DETAILED DESCRIPTION OF THE INVENTION

Figure 1:
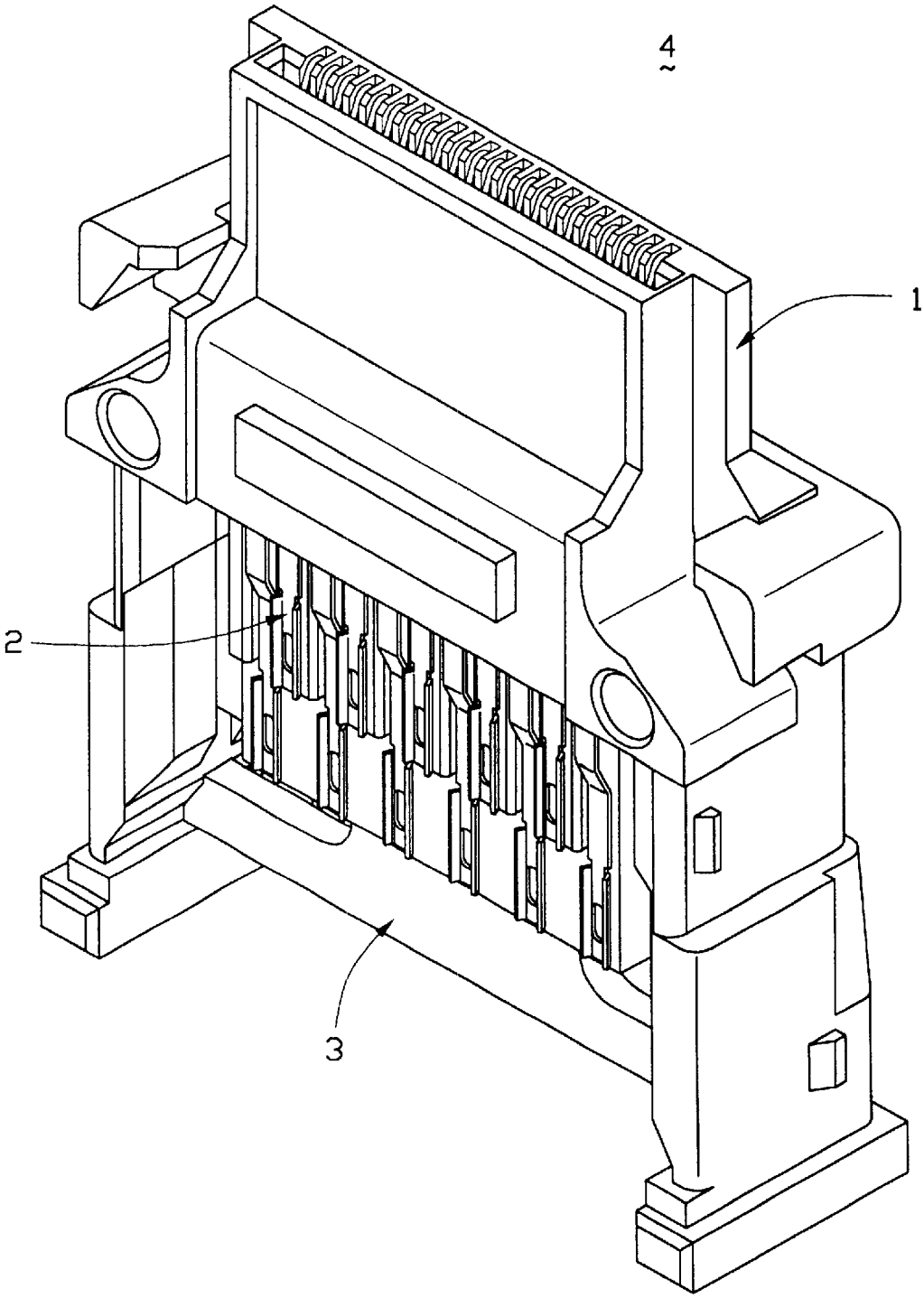
FIG. 1 is a perspective view of an electrical connector according to a preferred embodiment of the present invention.

The present invention will now be introduced in detail by referring to the accompanying drawings. Referring to FIG. 1, an electrical connector 4 in accordance with a preferred embodiment of the present invention includes an insulative housing 1, a plurality of conductive terminals 2 and an insulative partition 3.

Figure 2:
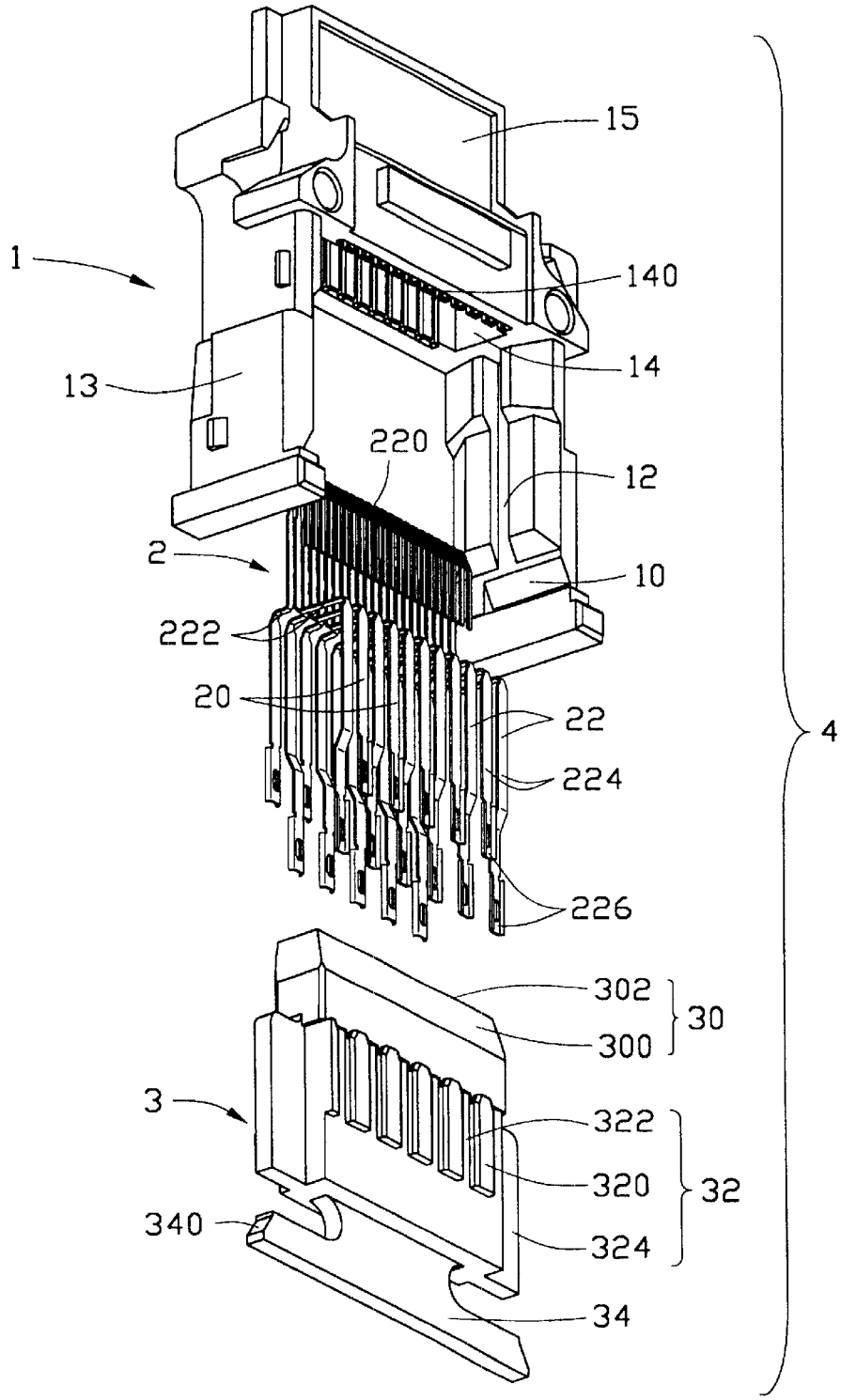
FIG. 2 is an exploded perspective view of the electrical connector of FIG. 1.

FIG. 2 shows the housing 1, terminals 2 and partition 3 in detail. The housing 1 is generally U-shaped. The housing 1 includes a body 15 defining a receiving cavity 14 therein, an inner step 17 (see FIG. 4) adjacent the cavity 14, and two arms 13 depending from opposite sides of the body 15 respectively. A plurality of receiving slots 140 is defined in each of two opposite inner walls of the body 15 adjacent and in communication with the receiving cavity 14, for receiving the terminals 2. Each arm 13 defines a vertical retaining groove 12 and a wedge-shaped horizontal positioning groove 10 in an inner surface thereof. The positioning groove 10 is disposed below the retaining groove 12. An engaging port 16 (see FIG. 4) is defined in a top surface of the housing 1, for receiving a mating connector (not shown).

The terminals 2 are generally arranged in two separate and opposite rows. Each row of terminals 2 comprises alternately arranged short and long terminals 20, 22. Each terminal 2 has an upper hook-shaped contact portion 220 for electrically engaging a corresponding terminal of the mating connector. The contact portions 220 of the two rows of the terminals 2 are arranged in a single line. A horizontal support portion 222 extends outwardly from a lower end of each contact portion 220. A tail portion 224 depends from an outer end of each support portion 222. Each tail portion 224 has a lower end 226 configured such that it can be conveniently soldered to a wire of a cable (not shown). The lower ends 226 of the tail portions 224 of the long terminals 22 are located below and inwardly from the lower ends 226 of the tail portions 224 of the short terminals 20, for facilitating easy soldering of the terminals 2 to the wires of the cable.

The partition 3 includes an upper matching portion 30, a central positioning portion 32 and a lower holding arm 34. The matching portion 30 has a blocking surface 302 at a top end thereof, and a slanted surface 300 declining from the blocking surface 302. The positioning portion 32 has vertical separators 320 formed on each of opposite side faces thereof, vertical positioning slots 322 defined between adjacent separators 320, and a pair of vertical retaining arms 324 extending perpendicularly from two vertical end faces thereof respectively. The holding arm 34 has a pair of sloping positioning faces 340 at lower portions of opposite vertical ends thereof respectively.

Figure 3:
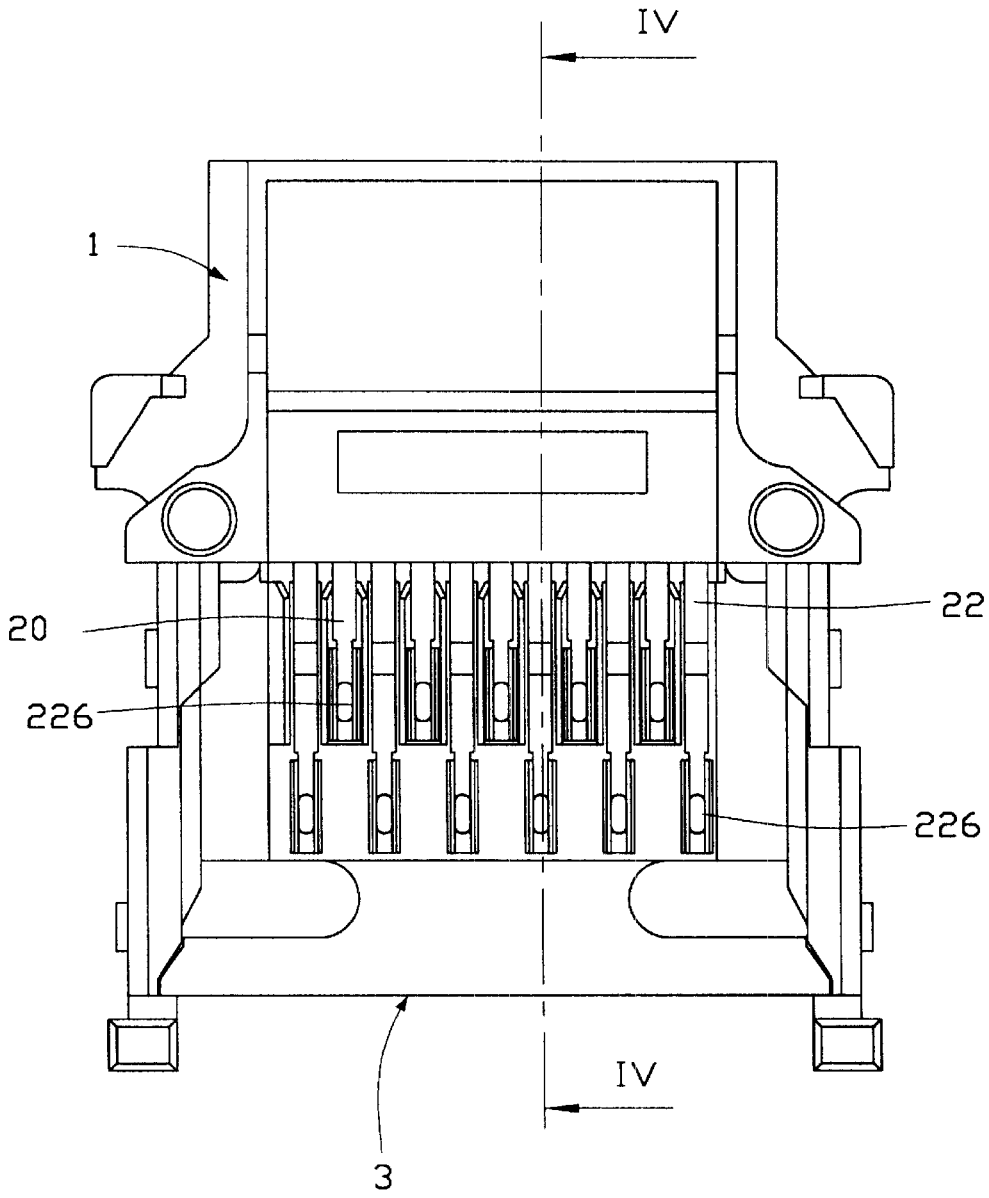
FIG. 3 is a front elevational view of the electrical connector of FIG. 1.
Figure 4:
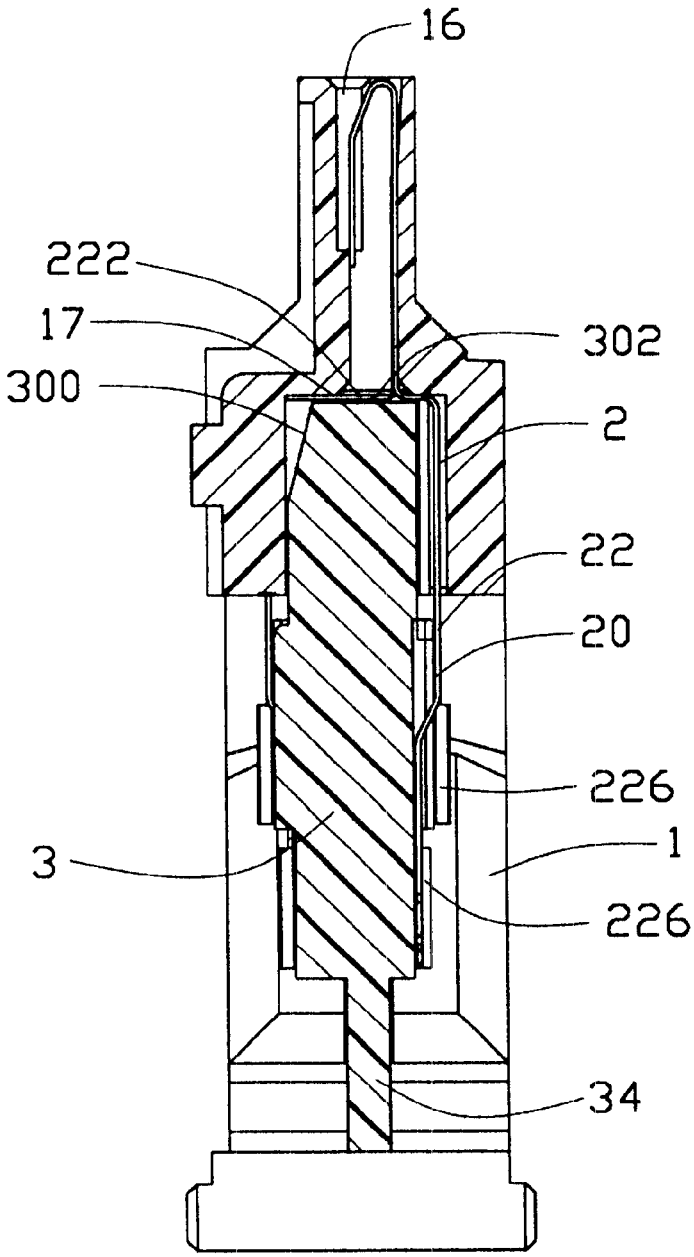
FIG. 4 is a cross-sectional view taken along line IV—IV of FIG. 3.

Referring to FIGS. 2, 3 and 4, in assembling the electrical connector 4, the partition 3 is inserted between the two rows of terminals 2. The slanted surface 300 of the partition 3 guides and facilitates insertion of the partition 3 between the two rows of terminals 2. The lower ends 226 of the tail portions 224 of the short terminals 20 overlie the separators 320. The lower ends 226 of the tail portions 224 of the long terminals 22 extend through the positioning slots 322 to rest on the said side faces of the positioning portion 32 below the separators 320. The blocking surface 302 of the matching portion 30 abuts against the supporting portions 222 of the terminals 2.

The combined partition 3 and terminals 2 is then inserted into the receiving cavity 14 of the housing 1. The support portions 222 of the terminals 2 are sandwiched between the blocking surface 302 of the partition 3 and the inner step 17 of the housing 1. The retaining arms 324 of the partition 3 are fittingly received in the retaining grooves 12 of the housing 1. The positioning faces 340 of the partition 3 securely engage in the positioning grooves 10 of the housing 1.

When the electrical connector 4 is connected with the mating connector, a board of the mating connector is inserted into the engaging port 16 of the housing 1. The board exerts a pushing force on the contact portions 220 of the terminals 2. The partition 3 resists such pushing force, thereby effectively preventing dislocation or distortion of the terminals 2.

Figure 5:
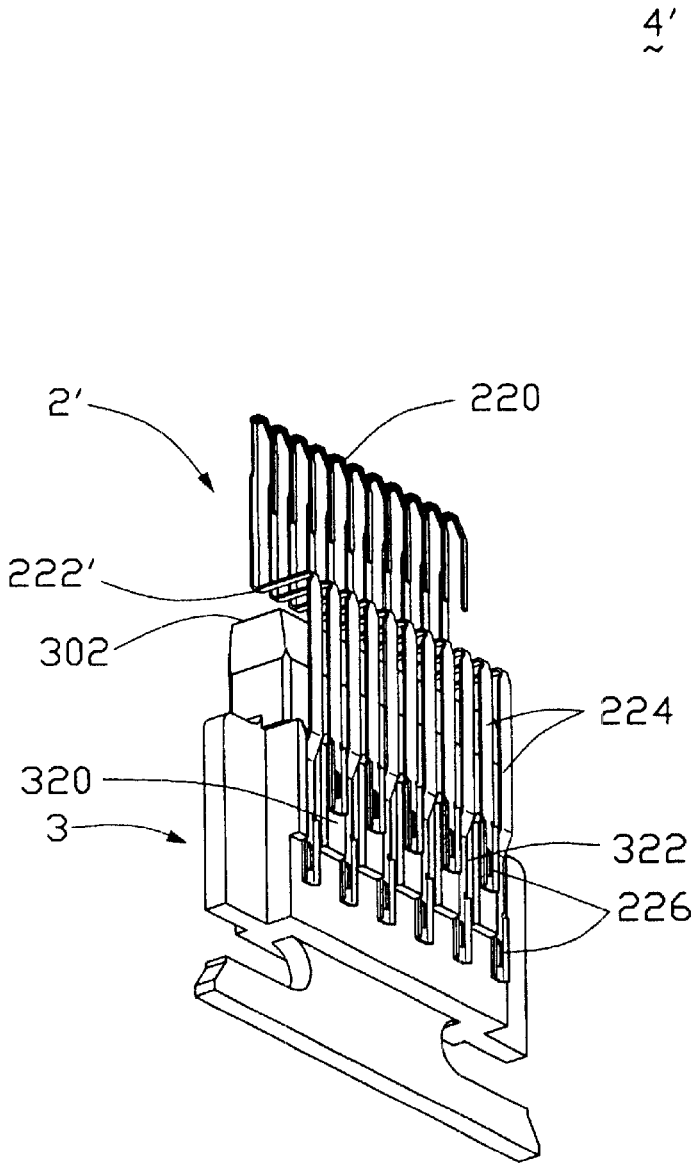
FIG. 5 is a perspective view of terminals and a partition of an electrical connector according to an alternative embodiment of the present invention.

FIG. 5 shows terminals 2' and the partition 3 of an electrical connector 4' in accordance with an alternative embodiment of the present invention. The terminals 2' are arranged in a single row. A length of each support portion 222' of the terminals 2' is approximately equal to a length of the blocking surface 302 of the partition 3. There are vertical separators 320 and vertical positioning slots 322 on one surface of the partition 3, to accommodate the tail portions 224 of the terminals 2' . In assembling the electrical connector 4', the terminals 2' are first inserted into the housing 1. Then the partition 3 is engaged with the terminals 2' and securely engaged with the housing 1.

Although the present invention has been described with reference to specific embodiments thereof, the description is illustrative and is not to be construed as limiting the invention. Various modifications to the present invention may be made to the preferred embodiments by those skilled in the art without departing from the true spirit and scope of the invention as defined by the appended claims.

I claim:

1. An electrical connector comprising:

an insulative housing including a body defining a receiving cavity therein and two arms depending from opposite sides of the body;

a plurality of conductive terminals received in the receiving cavity of the housing, each terminal including a contact portion adapted for electrically engaging with a mating connector and a support portion extending from a lower end of the contact portion, the contact portions being arranged in a single line and the terminals being generally arranged into two opposite rows; and an insulative partition inserted between the two rows of terminals, the partition having an upper blocking surface abutting the support portions of the terminals, and the partition being fixedly engaged with the arms of the housing and located therebetween;

wherein each of the two rows of terminals has alternately arranged long and short terminals, each long and short terminal has a tail portion, and each tail portion has a lower end adapted for soldering to a wire of a cable, the lower ends of the long terminals being located below and inwardly from the lower ends of the short terminals;

wherein the partition has a positioning portion forming a plurality of separators on each of two opposite side faces of the positioning portion, positioning slots are defined between adjacent separators, the tail portions of the long terminals are received in the positioning slots, and the tail portions of the short terminals overlie the separators;

wherein a plurality of receiving slots is defined in two opposite inner walls of the housing, the receiving slots are adjacent the receiving cavity, and the terminals have tail portions received in the receiving slots;

wherein each of the two arms of the housing defines a retaining groove and a positioning groove, the partition forms a pair of retaining arms and a pair of positioning faces, and the retaining arms and positioning faces are engaged in the retaining grooves and positioning grooves respectively;

wherein the positioning faces are formed on a holding arm of the partition, the holding arm being located at a lower portion of the partition;

wherein a slanted surface declines from the blocking surface of the partition, for facilitating insertion of the partition between the two opposite rows of terminals.

* * * * *